US011066288B2

(12) United States Patent
Christiansen et al.

(10) Patent No.: US 11,066,288 B2
(45) Date of Patent: Jul. 20, 2021

(54) SYSTEMS AND METHODS FOR DISPENSING A BEVERAGE STORED IN A COLLAPSIBLE BEVERAGE CONTAINER

(71) Applicant: Carlsberg Breweries A/S, Copenhagen (DK)

(72) Inventors: Jonas Christiansen, København (DK); Peter Bach, Copenhagen (DK)

(73) Assignee: Carlsberg Breweries A/S, Copenhagen (DK)

( * ) Notice: Subject to any disclaimer, the term of this patent is extended or adjusted under 35 U.S.C. 154(b) by 0 days.

(21) Appl. No.: 16/769,768

(22) PCT Filed: Dec. 4, 2018

(86) PCT No.: PCT/EP2018/083423

§ 371 (c)(1),
(2) Date: Jun. 4, 2020

(87) PCT Pub. No.: WO2019/110554

PCT Pub. Date: Jun. 13, 2019

(65) Prior Publication Data

US 2020/0385257 A1 Dec. 10, 2020

(30) Foreign Application Priority Data

Dec. 5, 2017 (EP) ..... 17205370

(51) Int. Cl.
*B67D 1/00* (2006.01)
*B67D 1/04* (2006.01)

(52) U.S. Cl.
CPC ..... *B67D 1/0462* (2013.01)

(58) Field of Classification Search
CPC ..... B67D 1/0462; B67D 1/0801; B67D 1/08; B67D 1/0804; B67D 2001/0827–0828;
(Continued)

(56) References Cited

U.S. PATENT DOCUMENTS 2,063,430 A * 12/1936 Graser ..... B05B 9/047 222/386.5
2,564,163 A * 8/1951 Leperre ..... C12N 1/22 141/2

(Continued)

FOREIGN PATENT DOCUMENTS

EP 2151414 A1 2/2010
EP 2826744 A1 1/2015

(Continued)

*Primary Examiner* — Paul R Durand
*Assistant Examiner* — Andrew P Bainbridge
(74) *Attorney, Agent, or Firm* — BakerHostetler

(57) ABSTRACT

A beverage dispensing system (10) for dispensing a beverage stored in a collapsible beverage container (18) comprising a base part (14), a beverage container connector for connecting to a beverage outlet of said collapsible beverage container (18), and a lid (12) connectable to said base part (14), in which said lid (12) and said base part (14) define a sealed inner space (16) for accommodating and encapsulating said collapsible beverage container (18), and in which said beverage dispensing system (10) further comprises a vacuum pump (32) in fluid communication with said inner space (16), thereby collapsing said collapsible beverage container (18) and forcing said beverage out of the collapsible beverage container (18) through a tapping line (26) and out through a tapping device (28).

10 Claims, 2 Drawing Sheets

(58) Field of Classification Search
CPC ..... B67D 7/0277; B67D 7/725; B67D 1/108; B67D 1/32
USPC ... 222/394, 399, 386.5, 389, 400.7, 95, 206, 222/214
See application file for complete search history.

(56) References Cited

U.S. PATENT DOCUMENTS 4,147,278 A * 4/1979 Uhlig ..... B65D 83/0055 222/400.8
4,484,697 A * 11/1984 Fry, Jr. ..... B67D 1/0007 222/1
4,771,918 A * 9/1988 Haggart ..... B65D 83/0061 222/95
5,240,144 A * 8/1993 Feldman ..... B67D 1/0001 222/105
5,638,995 A * 6/1997 Mazda ..... B65D 1/0292 222/215
6,824,017 B2 * 11/2004 Sluijter ..... B67D 1/0831 222/105
7,007,824 B2 * 3/2006 Danby ..... B65D 77/30 222/103
8,028,857 B2 * 10/2011 Rasmussen ..... B67D 1/0462 222/1
8,579,158 B2 * 11/2013 Rice ..... B65D 83/0055 222/95
2004/0007589 A1 * 1/2004 Leveen ..... B67D 1/0462 222/95
2004/0099695 A1 * 5/2004 Finn ..... B05B 9/047 222/386.5
2011/0253746 A1 * 10/2011 O'Keefe, Jr. ..... B67D 1/0005 222/132
2020/0385257 A1 * 12/2020 Christiansen ..... B67D 1/0462

FOREIGN PATENT DOCUMENTS

GB 2146705 A 4/1985
WO 2013/113657 A1 8/2013

* cited by examiner

SYSTEMS AND METHODS FOR DISPENSING A BEVERAGE STORED IN A COLLAPSIBLE BEVERAGE CONTAINER

CROSS-REFERENCE TO RELATED APPLICATIONS

This application is the National Stage of International Patent Application No. PCT/EP2018/083423 filed Dec. 4, 2018, which claims the benefit of European Patent Application No. 17205370.4 filed Dec. 5, 2017, the disclosure of which is incorporated herein by reference in its entirety for any and all purposes.

The present invention relates to systems and methods for dispensing a beverage stored in a collapsible beverage container

INTRODUCTION

Beverage dispensing systems are typically used in beverage dispensing establishments for efficiently dispensing large quantities of beverage. Typically, beverage dispensing systems are used to dispense carbonated alcoholic beverages such as draught beer and cider. However, also non-alcoholic beverages such as non-alcoholic beers, soft drinks and non-carbonated beverages such as wine and fruit juice may be dispensed using a beverage dispensing system. Beverage dispensing systems are mostly for professional users such as in establishments like bars, restaurants and hotels, however, increasingly also for private users such as in private homes.

Professional beverage dispensing systems typically dispense beverage provided in large beverage kegs. Such beverage kegs may hold 20-50 litres of beverage for a professional beverage dispensing system for allowing typically 50-100 beverage dispensing operations before needing to exchange the beverage keg. Typically, beverage kegs are made of solid materials such as steel and re-filled a number of times. In between each filling, the beverage kegs are carefully cleaned. Insufficient cleaning may lead to unhygienic beverage kegs, which may in turn lead to health problems for the beverage consumer. Alternatively, beverage kegs are made collapsible for single use only due to the above hygiene concern.

An example of such a beverage dispensing system using collapsible beverage kegs is the DraughtMaster™ system provided by the applicant company. Such beverage dispensing systems using collapsible beverage kegs typically have the beverage keg installed in a pressure chamber. When dispensing beverage from the beverage dispensing system, a pressure fluid is allowed to enter the beverage keg in case of using a metal keg, or the pressure chamber in case of using a collapsible keg. When using a non-collapsible keg, i.e. a metal keg, the keg itself may be considered to be the pressure chamber. During the dispensing of beverage from the pressure chamber, the pressure fluid acts on the beverage and forces the beverage out of the pressure chamber. If a collapsible beverage keg is used, the beverage keg collapses while dispensing the beverage, and the volume of the beverage keg is reduced corresponding to the amount of dispensed beverage. The collapsible beverage kegs are preferably made of flexible and disposable material such as plastic.

While performing a dispensing operation, the force of the pressure causes the beverage to flow out of the beverage container and into a tapping line. The tapping line leads to a tapping device typically having a tapping valve and a tapping handle for allowing an operator to control the tapping valve and thereby the beverage dispensing operation. The operator, such as a bartender or barmaid, uses the tapping device to control the rate of beverage dispensing.

EP 2151414 A1 discloses a modular beverage dispensing assembly comprising a collapsible beverage container within an airtight pressure container, where a compressor feeds pressurized gas into the pressure container to crush the collapsible beverage container and the pressure container has a corrugated lateral wall. This citation is silent about the provision of collapsible beverage containers without the use of pressures exceeding atmospheric pressure.

WO 2013/113657 A1 discloses a beverage dispensing system and method for dispensing beverage while preventing that gas from the head space of the collapsible beverage container enters the tapping line. This citation is also silent about the provision of collapsible beverage containers without the use of pressures exceeding atmospheric pressure.

In some cases it is not advisable to use a pressure chamber operating with an elevated pressure. In certain locations and/or jurisdictions, the operation of pressurized vessels may be inappropriate or even illegal. Such locations may be e.g. on board airplanes and in similar sensitive environments, or in countries which have developed a very restrictive policy regarding pressurized vessels and require very high standards and safety margins which in turn will result in higher production costs.

It is therefore an object according to the present invention to provide technologies for dispensing beverages from collapsible containers without the use of pressures exceeding atmospheric pressure.

SUMMARY OF THE INVENTION

According to a first aspect of the present invention, the above mentioned object and more are achieved by

- a beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said beverage dispensing system comprising:
- a base part including a beverage container connector for connecting to said beverage outlet of said collapsible beverage container,
- a tapping device for extracting said beverage from said beverage filled space and a tapping line extending from said beverage container connector to said tapping device, and
- a lid connectable to said base part, said lid and said base part defining a sealed inner space for accommodating and encapsulating said collapsible beverage container,
- wherein the lid is flexible and the beverage dispensing system further comprises a vacuum pump in fluid communication with said inner space for depressurizing said inner space for causing the flexible lid to apply a force onto said collapsible beverage container, thereby collapsing said collapsible beverage container and forcing said beverage from said beverage filled space through the tapping line and out through said tapping device.

The present invention relates to beverage dispensing systems using collapsible beverage containers according to the above umbrella definition. The specific concepts of the present invention will be explained in more detail with reference to the below mentioned embodiments of the first aspect.

The beverage container is a collapsible container, typically blow molded and preferably having a volume between 5-50 litres, which is constituted by a beverage filled space defined by the beverage and a gas filled head space which typically is carbon dioxide. The beverage container contains a beverage outlet which is closed off during transport and handling.

When installed in a beverage dispensing system, the beverage container is typically oriented in an "upside down" position, i.e. the beverage outlet is oriented in a downward direction so that the head space is thereby oriented in an upwards direction. The base part is typically rigid and suitable for supporting the weight of the beverage container, and the connector forms a fluid tight connection between the beverage outlet and the tapping line.

The tapping device comprises at least one tapping valve which is controlled by a handle or the like. A user wishing to dispense beverage will swing the handle and thereby operate and open the valve for allowing a flow of beverage from the beverage filled space to the tapping device.

The lid is connectable to the base part in a fluid tight fashion in order to be able to form a hermetically sealed inner space which has a suitable volume for encapsulating the beverage container. The base part is made of rigid material in order to support the beverage container. In the context of the present patent application, rigid material should be understood as being capable of supporting the weight of the beverage without bulging. Pressure is applied to the container in order to apply a dispensing pressure for forcing the beverage from the beverage filled volume to the tapping device when the tapping device, i.e. tapping valve, is open. The pressure should be sufficiently great to overcome the crumpling pressure of the beverage container, i.e. the pressure required for collapsing the beverage container, and as well overcome the pressure losses in the dispensing line, e.g. for elevating the beverage from a cellar located below a bar. Finally, a certain pressure at the tapping device is required for allowing a suitable flow velocity, however, too much pressure may cause undesired foaming.

Hence, in order to solve the problem connected to the use of pressurized vessels, it may be considered to use a vacuum, i.e. under atmospheric pressure, or simply sub-atmospheric pressure. The vacuum pump may be an ordinary air pump capable of maintaining an under atmospheric pressure in the inner space. By using a flexible lid and subjecting the inner space in which the beverage container is encapsulated to a vacuum, the atmospheric pressure will apply a force onto the beverage container through the lid.

Flexible in the context of the present patent application is understood to mean that it is made of a material which will be deformed when a force is applied to the material, the material will yield and conform to the applied force without breaking.

When the tapping valve is open, the pressure of barely one atmosphere will be sufficient for crumpling the beverage container and allow proper dispensing unless the beverage should be elevated more than at most a few meters and/or the tapping line is very long.

According to an embodiment of the first aspect, said flexible lid is made of an elastic material such as rubber or alternatively said flexible lid is made of a non-elastic flexible material such as plastic, e.g. made of soft plastic materials.

Most non-rigid materials may be used as a flexible lid. The lid must be fluid tight, but not able to resist pressure to any significant degree and must thus deform in accordance with the applied pressure. Both elastic materials, such as rubber, and non-elastic flexible material, such as plastic, are feasible. The lid will thus conform to the shape of the beverage container during dispensing.

According to an embodiment of the first aspect, said beverage dispensing system includes a plurality of base parts and a plurality of lids connectable to the base parts. The present beverage dispensing system may be expanded to an assembly including a plurality of base parts and a plurality of lids. The respective beverage container connectors of the base parts may be interconnected by a common tapping line to form a series connected assembly of beverage containers.

According to an embodiment of the first aspect, the beverage dispensing system further includes said collapsible beverage container stored in said inner space, said beverage from said beverage filled space being a carbonated beverage, preferably beer, the collapsible beverage container preferably being made of polymeric material such as plastic.

According to a second aspect of the present invention, the above mentioned object and more are achieved by a method of dispensing a beverage stored in a collapsible beverage container by using a beverage dispensing system, said collapsible beverage container defining a beverage filled space, a gas-filled head space and a beverage outlet in communication with said beverage filled space for extracting said beverage from said beverage filled space, the method comprising:

- providing a base part including a beverage container connector for connecting to said beverage outlet of said collapsible beverage container,
- providing a tapping device for extracting said beverage and a tapping line extending from said container connector to said tapping device,
- providing a lid connectable to said base part, said lid and said base part defining an inner space for accommodating said collapsible beverage container, and
- accommodating and encapsulating said collapsible beverage container in said inner space,
- wherein said lid is flexible and the method further comprises the steps of:
- providing a vacuum pump in fluid communication with said inner space, and
- depressurizing said inner space by using said vacuum pump, thereby causing said flexible lid to apply a force onto said collapsible beverage container for collapsing said collapsible beverage container and forcing said beverage from said beverage filled space through said tapping line and out through said tapping device.

The above method according to the second aspect correspond to specific embodiments of the beverage dispensing system in accordance with the first aspect. The method according to the second aspect may be used together with one or more of the embodiments of the beverage dispensing system in accordance with the first aspect.

According to a third aspect of the present invention, the above mentioned object and more are achieved by a beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said beverage dispensing system comprising:

- a base part including a beverage container connector for connecting to said beverage outlet of said collapsible beverage container, a tapping device for extracting said beverage from said beverage filled space and a tapping line extending from said beverage container connector to said tapping device, and a lid connectable to said base part, said lid and said base part defining a sealed inner space for accommodating and encapsulating said collapsible beverage container, wherein said lid is rigid and said beverage dispensing system further comprises a compressor in fluid communication with said inner space for pressurizing said inner space for applying a force onto said collapsible beverage container, collapsing said collapsible beverage container and forcing said beverage from said beverage filled space through said tapping line and out through said tapping device.

Hence, alternatively to the use of a flexible lid, the lid may also be rigid and the inner space may be connected to a compressor in order to form a beverage dispensing system operating with pressures above atmospheric pressure. Such beverage dispensing systems have the advantage of allowing a pressure difference greater than one bar, and thus the force applied to the beverage container may be greater than the previous beverage dispensing systems operating with underpressure. However, this solution is not suitable for environments in which pressurized vessels are prohibited.

According to a fourth aspect of the present invention, the beverage dispensing system according to the first aspect may be combined with the beverage dispensing system according to the third aspect. Accordingly, the above mentioned objects and more are achieved by a beverage dispensing system comprising:

i) a first beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said first beverage dispensing system comprising:

a base part including a beverage container connector for connecting to said beverage outlet of said collapsible beverage container, a lid connectable to said base part, said lid and said base part defining a sealed inner space for accommodating and encapsulating said collapsible beverage container, wherein said lid is flexible and said first beverage dispensing system further comprises a vacuum pump in fluid communication with said inner space for depressurizing said inner space for causing said flexible lid to apply a force onto said collapsible beverage container, thereby collapsing said collapsible beverage container and forcing said beverage from said beverage filled space, and ii) a second beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said second beverage dispensing system comprising:

a base part including a beverage container connector for connecting to said beverage outlet of said collapsible beverage container, a lid connectable to said base part, said lid and said base part defining a sealed inner space for accommodating and encapsulating said collapsible beverage container, wherein said lid is rigid and said second beverage dispensing system further comprises a compressor in fluid communication with said inner space for pressurizing said inner space for applying a force onto said collapsible beverage container, collapsing said collapsible beverage container and forcing said beverage from said beverage filled space.

In an embodiment of the fourth aspect, the beverage dispensing system comprises a tapping device for extracting said beverage from any of said beverage filled spaces and a common tapping line extending from any of said beverage container connectors to said tapping device. The beverage from said beverage filled space is forced through said common tapping line and out through said tapping device.

In another embodiment of the fourth aspect, the first or second beverage system includes a plurality of base parts and a plurality of lids connectable to said base parts.

Any of the embodiments of the first aspect may be used together with any of the embodiments of the fourth aspect.

DETAILED DESCRIPTION OF THE FIGURES

Figure 1A:
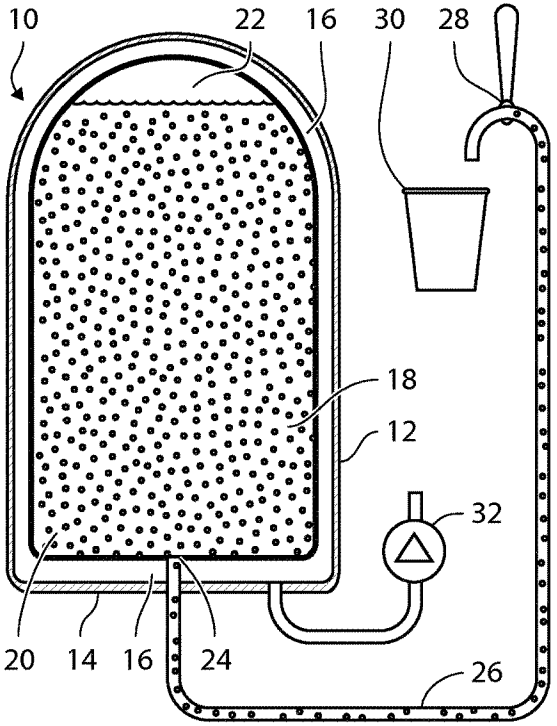
FIG. 1A is a beverage dispensing system having a flexible and elastic lid including a filled keg.

FIG. 1A shows a side view of a beverage dispensing system 10 having a pressure chamber comprising an elastic lid 12 and a rigid base part 14, which are sealed together establishing an inner volume 16 including a filled beverage container 18. The beverage container 18, also known as keg, is of the collapsible type made of a collapsible polymeric material, thus the term collapsible beverage container. The collapsible beverage container 18 defines a beverage filled space containing beverage 20, typically being a carbonated beverage such as beer. The beverage container 18 also typically defines a gas filled head space 22.

The elastic lid 12 and the rigid base part 14 are separable but during operation they are sealed together for defining the inner volume 16 for accommodating the beverage container 18. The elastic lid 12 may e.g. be made of rubber. The beverage container 18 defines a beverage outlet 24 which is connected to a tapping line 26 which extends through the base part 14 to a tapping device 28. The base part 14 includes a beverage container connector (not shown) for connecting to said beverage outlet 24 of said collapsible beverage container. The tapping device 28 includes a tapping valve which may be operated by a handle for enabling and disabling a flow of beverage from the beverage container 18 through the tapping line 26 and tapping device 28 to beverage glass 30.

The base part 14 is also connected to a vacuum pump 32. The vacuum pump 32 is capable of removing air from the sealed inner volume 16 between the beverage container 18 and the pressure chamber comprising elastic lid 12 and base part 14 in order to establish a sub-atmospheric pressure inside inner volume 16. As the elastic lid 12 is flexible, it will yield to the force established by the pressure difference between the atmospheric pressure outside the pressure chamber and the sub-atmospheric pressure inside the inner volume 16. When the tapping device 28 is enabling beverage flow, the force will cause the elastic pressure lid 12 to yield and apply a force onto the beverage container 18, which will start to collapse as beverage is forced out of the beverage container 18 and towards the tapping device 28.

Figure 1B:
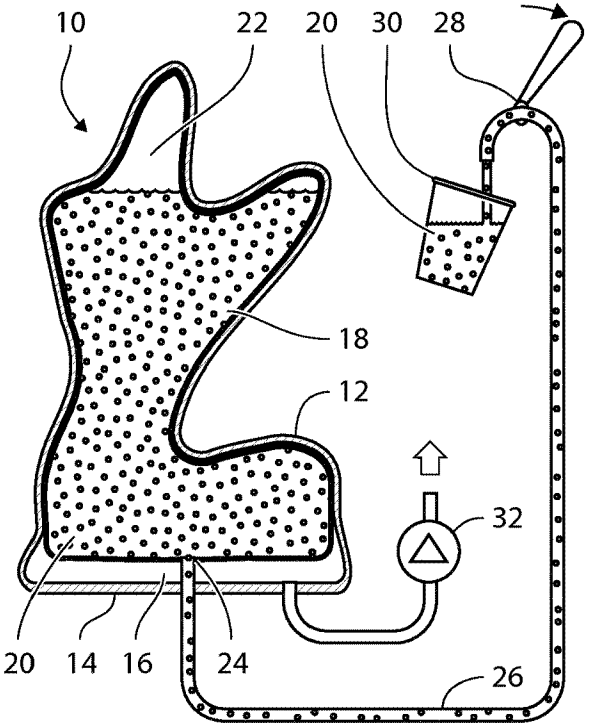
FIG. 1B is a beverage dispensing system having a flexible and elastic lid during dispensing.

FIG. 1B shows a side view of a beverage dispensing system 10 having a pressure chamber comprising an elastic lid 12 during dispensing. When a significant volume of beverage has been dispensed, the beverage container 18 will have collapsed and the elastic lid 12 will have assumed a tight fit about the beverage container 18.

Figure 1C:
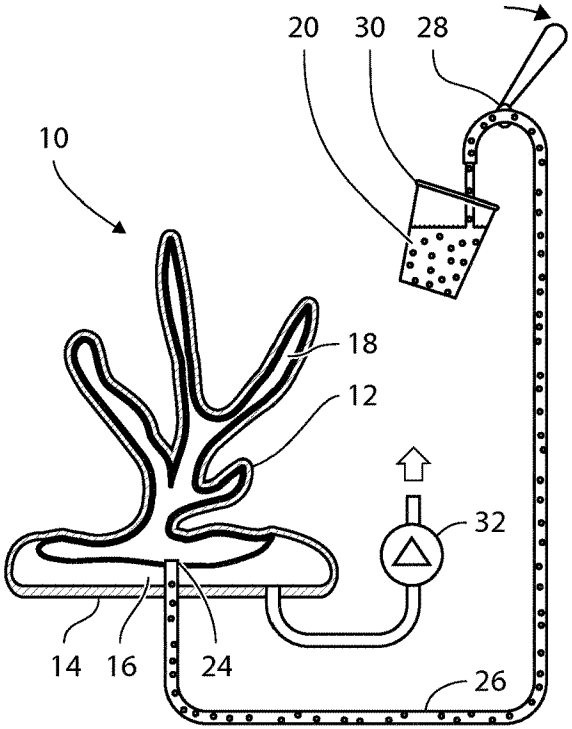
FIG. 1C is a beverage dispensing system having a flexible and elastic lid including an empty keg.

FIG. 1C shows a side view of a beverage dispensing system 10 having a pressure chamber comprising an elastic lid 12 including an empty beverage container 18. When all of the beverage in the beverage container 18 has been dispensed, the beverage container 18 will be fully collapsed or compressed while the elastic lid 12 has assumed a tight fit about the beverage container 18. Now, the elastic lid 12 may be removed from the base part 14 and the beverage container 18 may be exchanged. Thereafter, dispensing operations may be resumed.

Figure 2A:
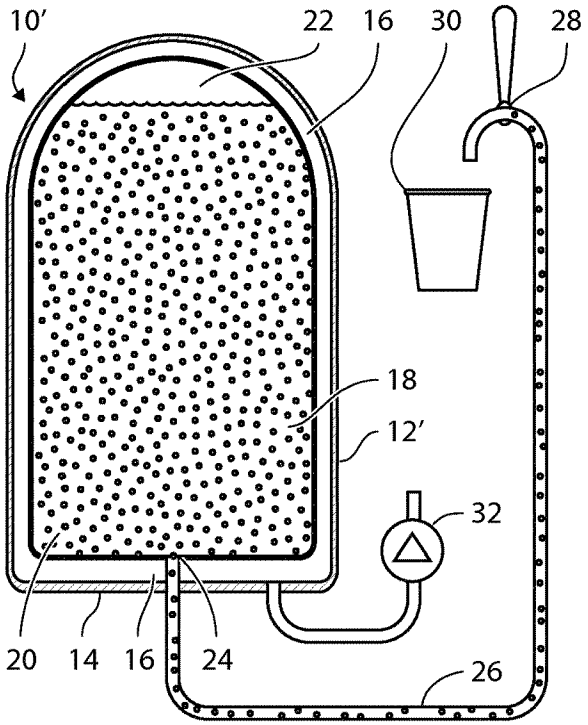
FIG. 2A is a beverage dispensing system having a flexible pressure chamber including a filled keg.

FIG. 2A shows a side view of a beverage dispensing system 10' having a pressure chamber comprising non-elastic lid 12' including a filled beverage container 18. The present beverage dispensing system 10' is similar to the previous embodiment except that the flexible lid 12' is non-elastic or substantially non-elastic. It may e.g. be made of soft plastic materials.

Figure 2B:
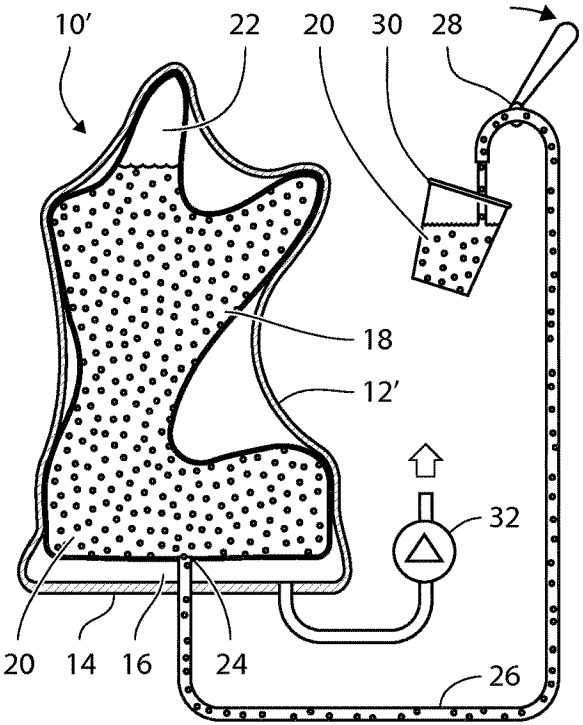
FIG. 2B is a beverage dispensing system having a flexible pressure chamber during dispensing.

FIG. 2B shows a side view of a beverage dispensing system 10' having a pressure chamber comprising non-elastic lid 12' during dispensing. The present beverage dispensing system 10' is similar to the previous embodiment except that the lid 12' will not form a tight fit about the collapsing beverage container 18 but instead be folded about the beverage container 18 during dispensing.

Figure 2C:
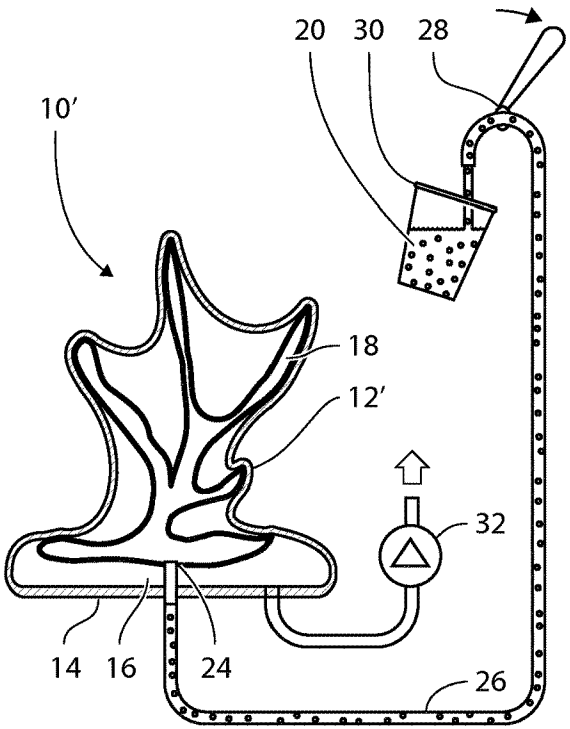
FIG. 2C is a beverage dispensing system having a flexible pressure chamber including an empty keg.

FIG. 2C shows a side view of a beverage dispensing system 10' having a pressure chamber comprising non-elastic lid 12' including an empty beverage container 18. When all of the beverage in the beverage container 18 has been dispensed, the beverage container 18 will be fully collapsed or compressed whereas the lid 12' has been folded about the beverage container 18. Now, the flexible lid 12' may be removed from the base part 14 and the beverage container 18 may be exchanged. Thereafter, dispensing operations may be resumed.

REFERENCE NUMERALS

10. Beverage dispensing system
12. Flexible lid
14. Rigid base part
16. Inner volume
18. Beverage container
20. Beverage
22. Head space
24. Beverage outlet
26. Tapping line
28. Tapping device
30. Glass
32. Vacuum pump The invention is characterized by the following points:

1. A beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said beverage dispensing system comprising:
   - a base part including a beverage container connector for connecting to said beverage outlet of said collapsible beverage container,
   - a tapping device for extracting said beverage from said beverage filled space and a tapping line extending from said beverage container connector to said tapping device, and
   - a lid connectable to said base part, said lid and said base part defining a sealed inner space for accommodating and encapsulating said collapsible beverage container, wherein said lid is flexible and said beverage dispensing system further comprises a vacuum pump in fluid communication with said inner space for depressurizing said inner space for causing said flexible lid to apply a force onto said collapsible beverage container, thereby collapsing said collapsible beverage container and forcing said beverage from said beverage filled space through said tapping line and out through said tapping device.

2. The beverage dispensing system according to point 1, wherein said flexible lid is made of an elastic material such as rubber or alternatively wherein said flexible lid is made of a non-elastic flexible material such as plastic.

3. The beverage dispensing system according to any of the preceding points, wherein said beverage dispensing system includes a plurality of base parts and a plurality of lids connectable to said base parts.

4. The beverage dispensing system according to any of the preceding points, wherein said beverage from said beverage filled space of said collapsible beverage container is a carbonated beverage preferably beer, said collapsible beverage container preferably being made of polymeric material such as plastic.

5. A method of dispensing a beverage stored in a collapsible beverage container by using a beverage dispensing system, said collapsible beverage container defining a beverage filled space, a gas-filled head space and a beverage outlet in communication with said beverage filled space for extracting said beverage from said beverage filled space, the method comprising:
   - providing a base part including a beverage container connector for connecting to said beverage outlet of said collapsible beverage container,
   - providing a tapping device for extracting said beverage and a tapping line extending from said container connector to said tapping device,
   - providing a lid connectable to said base part, said lid and said base part defining an inner space for accommodating said collapsible beverage container, and
   - accommodating and encapsulating said collapsible beverage container in said inner space, wherein said lid is flexible and the method further comprises the steps of:
   - providing a vacuum pump in fluid communication with said inner space, and
   - depressurizing said inner space by using said vacuum pump, thereby causing said flexible lid to apply a force onto said collapsible beverage container for collapsing said collapsible beverage container and forcing said beverage from said beverage filled space through said tapping line and out through said tapping device.

6. A beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said beverage dispensing system comprising:

a base part including a beverage container connector for connecting to said beverage outlet of said collapsible beverage container, a tapping device for extracting said beverage from said beverage filled space and a tapping line extending from said beverage container connector to said tapping device, and a lid connectable to said base part, said lid and said base part defining a sealed inner space for accommodating and encapsulating said collapsible beverage container, wherein said lid is rigid and said beverage dispensing system further comprises a compressor in fluid communication with said inner space for pressurizing said inner space for applying a force onto said collapsible beverage container, collapsing said collapsible beverage container and forcing said beverage from said beverage filled space through said tapping line and out through said tapping device.

7. A beverage dispensing system comprising:

i) a first beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said first beverage dispensing system comprising:

a base part including a beverage container connector for connecting to said beverage outlet of said collapsible beverage container, a lid connectable to said base part, said lid and said base part defining a sealed inner space for accommodating and encapsulating said collapsible beverage container, wherein said lid is flexible and said first beverage dispensing system further comprises a vacuum pump in fluid communication with said inner space for depressurizing said inner space for causing said flexible lid to apply a force onto said collapsible beverage container, thereby collapsing said collapsible beverage container and forcing said beverage from said beverage filled space, and ii) a second beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said second beverage dispensing system comprising:

a base part including a beverage container connector for connecting to said beverage outlet of said collapsible beverage container, a lid connectable to said base part, said lid and said base part defining a sealed inner space for accommodating and encapsulating said collapsible beverage container, wherein said lid is rigid and said second beverage dispensing system further comprises a compressor in fluid communication with said inner space for pressurizing said inner space for applying a force onto said collapsible beverage container, collapsing said collapsible beverage container and forcing said beverage from said beverage filled space.

8. The beverage dispensing system according to point 7, wherein the beverage dispensing system comprises a tapping device for extracting said beverage from any of said beverage filled spaces and a common tapping line extending from any of said beverage container connectors to said tapping device.

9. The beverage dispensing system of points 7 or 8, wherein the first or second beverage system includes a plurality of base parts and a plurality of lids connectable to said base parts.

The invention claimed is:

1. A beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said beverage dispensing system comprising:

a base part including a beverage container connector for connecting to said beverage outlet of said collapsible beverage container;

a tapping device for extracting said beverage from said beverage filled space and a tapping line extending from said beverage container connector to said tapping device; and a lid connectable to said base part, said lid and said base part defining a sealed inner space for accommodating and encapsulating said collapsible beverage container, wherein said lid is flexible and said beverage dispensing system further comprises a vacuum pump in fluid communication with said inner space for depressurizing said inner space for causing said flexible lid to apply a force onto said collapsible beverage container, thereby collapsing said collapsible beverage container and forcing said beverage from said beverage filled space through said tapping line and out through said tapping device.

2. The beverage dispensing system of claim 1, wherein said flexible lid is made of an elastic material such as rubber or alternatively wherein said flexible lid is made of a non-elastic flexible material such as plastic.

3. The beverage dispensing system of claim 1, wherein said beverage dispensing system includes a plurality of base parts and a plurality of lids connectable to said base parts.

4. The beverage dispensing system of claim 1, wherein said beverage from said beverage filled space of said collapsible beverage container is a carbonated beverage.

5. The beverage dispensing system of claim 4, wherein the carbonated beverage is beer.

6. The beverage dispensing system of claim 4, wherein the collapsible beverage container is made of polymeric material or plastic.

7. A method of dispensing a beverage stored in a collapsible beverage container by using a beverage dispensing system, said collapsible beverage container defining a beverage filled space, a gas-filled head space and a beverage outlet in communication with said beverage filled space for extracting said beverage from said beverage filled space, the method comprising:

providing a base part including a beverage container connector for connecting to said beverage outlet of said collapsible beverage container;

providing a tapping device for extracting said beverage and a tapping line extending from said container connector to said tapping device;

providing a lid connectable to said base part, said lid and said base part defining an inner space for accommodating said collapsible beverage container;

accommodating and encapsulating said collapsible beverage container in said inner space, wherein said lid is flexible;

providing a vacuum pump in fluid communication with said inner space; and depressurizing said inner space by using said vacuum pump, thereby causing said flexible lid to apply a force onto said collapsible beverage container for collapsing said collapsible beverage container and forcing said beverage from said beverage filled space through said tapping line and out through said tapping device.

8. A beverage dispensing system comprising:

a first beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said first beverage dispensing system comprising:

a base part including a beverage container connector for connecting to said beverage outlet of said collapsible beverage container, and a lid connectable to said base part, said lid and said base part defining a sealed inner space for accommodating and encapsulating said collapsible beverage container, wherein said lid is flexible and said first beverage dispensing system further comprises a vacuum pump in fluid communication with said inner space for depressurizing said inner space for causing said flexible lid to apply a force onto said collapsible beverage container, thereby collapsing said collapsible beverage container and forcing said beverage from said beverage filled space; and a second beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said second beverage dispensing system comprising:

a base part including a beverage container connector for connecting to said beverage outlet of said collapsible beverage container, and a lid connectable to said base part, said lid and said base part defining a sealed inner space for accommodating and encapsulating said collapsible beverage container, wherein said lid is rigid and said second beverage dispensing system further comprises a compressor in fluid communication with said inner space for pressurizing said inner space for applying a force onto said collapsible beverage container, collapsing said collapsible beverage container and forcing said beverage from said beverage filled space.

9. The beverage dispensing system of claim 8, wherein the beverage dispensing system comprises a tapping device for extracting said beverage from any of said beverage filled spaces and a common tapping line extending from any of said beverage container connectors to said tapping device.

10. The beverage dispensing system of claim 8, wherein the first beverage dispensing system or the second beverage dispensing system includes a plurality of base parts and a plurality of lids connectable to said base parts.

* * * * *